United States Patent [19]

Harris

[11] Patent Number: 4,537,249

[45] Date of Patent: Aug. 27, 1985

[54] HEAT FLUX LIMITING SLEEVES

[75] Inventor: William G. Harris, Tampa, Fla.

[73] Assignee: The United States of America as represented by the United States Department of Energy, Washington, D.C.

[21] Appl. No.: 230,554

[22] Filed: Feb. 2, 1981

[51] Int. Cl.[3] ..... F28F 13/14

[52] U.S. Cl. ..... 165/134 R; 165/135

[58] Field of Search ..... 165/146, 147, 134 R, 165/160, 161, 135; 285/177, 158

[56] References Cited

U.S. PATENT DOCUMENTS

| | | | |
|---|---|---|---|
| 1,762,467 | 6/1930 | Bovey | 165/135 |
| 2,315,792 | 4/1943 | Hoss | 285/177 |
| 2,420,373 | 5/1947 | Hogberg | 165/135 X |
| 3,132,691 | 5/1964 | Esleeck | 165/134 |
| 3,333,123 | 7/1967 | Baumann | 165/147 |
| 3,630,274 | 12/1971 | Lievense | 165/134 |
| 3,743,252 | 7/1973 | Schott, Jr. | 165/146 |
| 3,982,901 | 9/1976 | Steevel et al. | 165/134 |

FOREIGN PATENT DOCUMENTS

| | | | |
|---|---|---|---|
| 2097056 | 7/1972 | France . | |
| 1225967 | 3/1971 | United Kingdom | 165/134 |
| 821897 | 4/1981 | U.S.S.R. | 165/147 |

*Primary Examiner*—Michael Koczo

*Attorney, Agent, or Firm*—F. J. Baehr, Jr.

[57] ABSTRACT

A heat limiting tubular sleeve extending over only a portion of a tube having a generally uniform outside diameter, the sleeve being open on both ends, having one end thereof larger in diameter than the other end thereof and having a wall thickness which decreases in the same direction as the diameter of the sleeve decreases so that the heat transfer through the sleeve and tube is less adjacent the large diameter end of the sleeve than adjacent the other end thereof.

7 Claims, 4 Drawing Figures

HEAT FLUX LIMITING SLEEVES

BACKGROUND OF THE INVENTION

This invention relates to heat exchanger tubes and more particularly to heat flux limiting sleeves for heat exchanger tubes.

Steam generators utilized with Liquid Metal Fast Breeder Reactors (LMFBR) and designed to produce dry saturated steam will see severe temperature differences between the hot sodium on the shell side and the saturated water within the tubes. Normally with the heat exchanger, the greater the temperature differential, the greater the effectiveness of the heat exchanger elements. However, there appears to an upper limit above which high heat transfer rates can cause tube damage due to chemical concentrations and rapid temperature fluctuations, particularly at the boiling surfaces. The combination of liquid metal on the shell side and nucleate boiling within the tubes results in extremely high heat fluxes. When prestressed double wall tubes are utilized in LMFBR steam generators, the temperature differential across the double wall tubes may be sufficient to produce separation at the interface of the walls. Thus, to protect single and double wall tubes a heat flux limiter is required.

SUMMARY OF THE INVENTION

A heat flux limiting sleeve for a heat exchanger tube, when made in accordance with this invention, extends over a portion of the tube and has one end thereof larger than the other end thereof whereby the heat transferred through the sleeve and through the tube is less on one end of the sleeve than it is on the other and the heat transfer changes at a predetermined rate from one end of the sleeve to the other.

BRIEF DESCRIPTION OF THE DRAWINGS

The objects and advantages of this invention will become more apparent from reading the following detail description in conjunction with the accompanying drawings, in which.

DESCRIPTION OF THE PREFERRED EMBODIMENT

Figure 1:
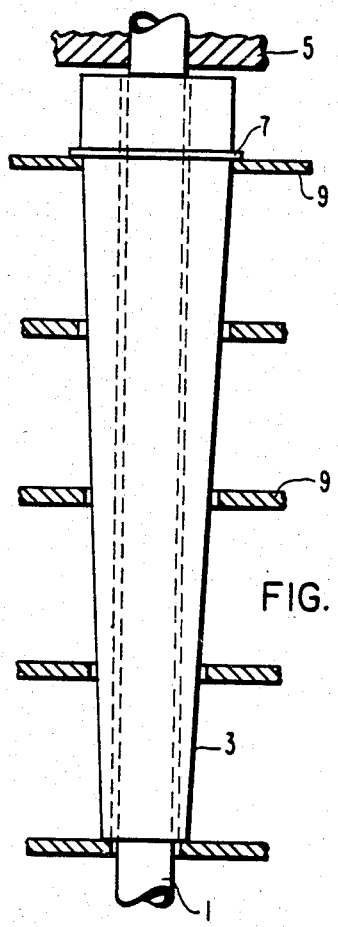
FIG. 1 is a partial elevational view of a heat exchanger tube with a heat flux limiting sleeve made in accordance with this invention.

Referring now to the drawings in detail and in particular to FIG. 1, there is shown a portion of a heat exchanger tube 1 over which a heat flux limiting sleeve 3 is disposed adjacent an upper tubesheet 5. The sleeve 3 is larger in diameter on one end, the upper end, than it is on the other end, the lower end. The sleeve 3 tapers inwardly from the upper to the lower end. An outwardly extending flange 7 is disposed adjacent the upper end of the sleeve 3 and supports the sleeve 3 on one of several support plates 9 disposed along the length of the sleeve 3.

Figure 2:
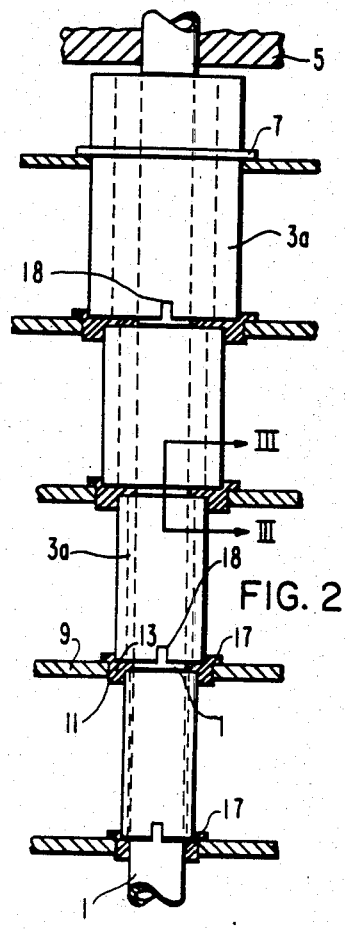
FIG. 2 is a partial elevational view of an alternative embodiment.
Figure 3:
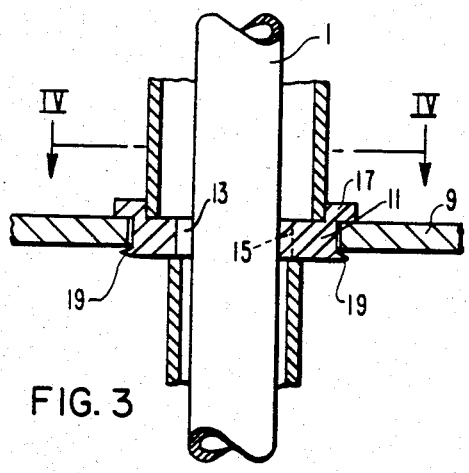
FIG. 3 is an enlarged partial sectional view taken on line III—III of FIG. 2.
Figure 4:
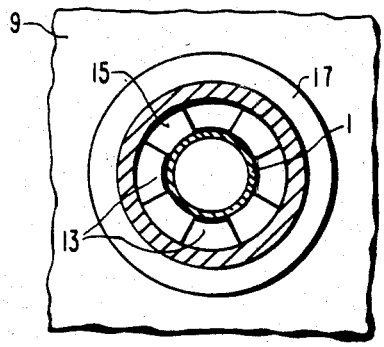
FIG. 4 is a sectional view taken on line IV—IV of FIG. 3.

As shown in FIGS. 2, 3, and 4, the heat flux shield may comprise a plurality of generally cylindrical portions 3*a* graduated in diameter, the upper cylindrical portions 3*a* being larger in diameter than the lower cylindrical portions 3*a*. A collar 11 is disposed between adjacent cylindrical portions 3*a*. The collars 11 allow for axial expansion between adjacent cylindrical portions 3*a* and are counterbored from each end to receive the respective cylindrical portions 3*a*. A land 13 is disposed between the counterbores and has grooves 15 disposed therein for the passage of fluid from one cylindrical portion to the adjacent cylindrical portion. The land 13 is only slightly larger in diameter than the tubes. Drain vent slots 18 are provided in the cylindrical portions 3*a* or in the collars 11. The collars 11 also have an outwardly extending flange 17 disposed on the upper end thereof and the collars fit into a hole in the support plates 9. Stakes 19 as shown in FIG. 3 may be provided for fastening the collars 11 in the support plates 9.

The heat flux sleeves 3 hereinbefore described also have a wall thickness which decreases in the same direction as the diameter decreases. The inside diameter of the sleeves 3 may be constant, may vary in the same direction or in the opposite direction as the outside diameter to provide an effective, inexpensive, and reliable heat flux sleeve for a liquid metal steam generator.

What is claimed is:

1. A heat flux limiting tubular sleeve for a single heat exchanger tube having a generally uniform outside diameter, said tubular sleeve extending over only a portion of said tube, being open on both ends, having one end of the tubular sleeve larger in diameter than the other end thereof and having a wall thickness which decreases in the same direction as the diameter of the sleeve decreases, whereby the heat transferred through the tubular sleeve and tube is less on the larger diameter end of the sleeve than on the other end thereof.

2. A heat flux limiting sleeve as set forth in claim 1, wherein the sleeve is tapered.

3. A heat flux limiting sleeve as set forth in claim 1, wherein the sleeve comprises a plurality of cylindrical portions which decrease in diameter from one end of the sleeve to the other.

4. A heat flux limiting sleeve as set forth in claim 3 and further comprising a plurality of collars disposed between adjacent cylindrical portions.

5. A heat flux limiting sleeve as set forth in claim 4 wherein the collar has a counterbore on each end thereof, the diameter of the counterbore varying to receive adjacent sleeve portions.

6. A heat flux limiting sleeve as set forth in claim 5, wherein the collars have an outwardly extending flange on one end thereof.

7. A heat flux limiting sleeve as set forth in claim 4, wherein the collars have a centrally disposed portion which is in close proximity to the tubes and a groove disposed in the centrally disposed portion to allow fluid to flow on the outer side of the tubes and between cylindrical portions of the sleeve.

* * * * *